United States Patent [19]

Ransom

[11] Patent Number: 4,651,766

[45] Date of Patent: Mar. 24, 1987

[54] VACUUM LIMITING ARRANGEMENT

[75] Inventor: Keith C. Ransom, Benfleet, United Kingdom

[73] Assignee: Ford Motor Company, Dearborn, Mich.

[21] Appl. No.: 803,741

[22] Filed: Dec. 2, 1985

[30] Foreign Application Priority Data

Dec. 5, 1984 [GB] United Kingdom ..... 8430734

[51] Int. Cl.[4] ..... G05D 16/06

[52] U.S. Cl. ..... 137/116.3; 123/409; 123/568; 137/907

[58] Field of Search ..... 123/409, 568; 137/103, 137/116.3, 907

[56] References Cited

U.S. PATENT DOCUMENTS

| | | | |
|---|---|---|---|
| 2,950,730 | 8/1960 | Svensson | 137/116.3 |
| 3,606,871 | 9/1971 | Gropp | 123/409 |
| 4,106,452 | 8/1978 | Mizutani | 123/568 |
| 4,195,605 | 4/1980 | Weathers et al. . | |
| 4,359,034 | 11/1982 | Mase et al. . | |

FOREIGN PATENT DOCUMENTS 2027230 2/1980 United Kingdom .

*Primary Examiner*—Robert G. Nilson

*Attorney, Agent, or Firm*—Robert E. McCollum; Clifford L. Sadler

[57] ABSTRACT

A vacuum limiting arrangement uses a three-port, two-position valve in conjunction with a vacuum sustaining valve to limit the vacuum applied to a vacuum driven device. A source of vacuum, such as engine intake manifold vacuum, is connected to one of two end ports. The device is connected to a central port, and the other end port is vented. The device can thus be connected either to the vacuum source in one position of the control valve or to vent. A control port that is effective to switch the control valve is connected into a vacuum line between the control valve and the device. The sustaining valve allows free flow of air from the device to the control valve, but only a restricted flow in the opposite direction to provide a hysterises to the system for controlling the shifting of the control valve, which is accomplished automatically as a function of the vacuum level at the device and in the control port.

3 Claims, 4 Drawing Figures

VACUUM LIMITING ARRANGEMENT

This invention relates to a vacuum limiting arrangement for limiting the vacuum applied to a vacuum-driven device.

Many components in the engine compartment of a motor vehicle are driven by vacuum, usually by vacuum derived from the engine intake manifold. Although such components, e.g., the distributor, exhaust gas recirculation (EGR) valves and deceleration valves, are required to follow the varying value of the vacuum produced by the engine, it is necessary to provide a means for limiting the vacuum applied to the device to prevent damage to the device.

In known vacuum limiting devices, it is usual to limit the vacuum by bleeding atmospheric air into the supply vacuum. A result of this is that all devices fed by the same supply vacuum are equally affected, and this may be undesirable.

According to the present invention, there is provided a vacuum limiting arrangement, the arrangement comprising a vacuum operated three-port, two position control valve with a control port, and a vacuum driven device, a first central port of the control valve and the control port both communicating with the device, and the central port being able to be connected to either of two end ports on opposite sides of the central port, and a vacuum sustaining valve in the vacuum line between the central port and the control valve arranged to allow vacuum to flow through the line toward the device but to restrict vacuum flow in the opposite direction.

Preferably, the control port is connected into the line between the central port and the device, at a position between the vacuum sustaining valve and the device. A simple T-connector can be used.

A second port, one of the end ports, can be connected to a vacuum source, and the third port, or other end port, can be a bleed port.

The three-port, two position control valve is preferably a snap-action type of valve, for example, as fully shown and described in U.S. Ser. No. 805,493 filed Dec. 5, 1985, titled "Pressure Operated Valve"

When the second port that is connected to vacuum is connected to the central port, supply vacuum is admitted to the device past a vacuum sustaining valve. This same vacuum is also routed from the device, or from the vacuum line leading to the device, via the T-connector back to the control port of the control valve.

If the source vacuum in the control port is below the level needed to actuate the control valve, no change will occur to the valve positions.

If the source vacuum rises above the limiting value, then the vacuum at the control port will move the control valve to its alternate position so that the central port now communicates with the third, or other end vent port. The operated device now communicates with the central port through the vacuum sustaining valve, and so the vacuum flow from the device is restricted and only slowly decays.

Even though the vacuum in the device decays, it is still being fed to the control port. Once the vacuum has decayed to a certain level, however, the vacuum at the control port will no longer be effective to hold the control valve in its alternate position, and it will switch back again to its original position reconnecting the central port and the source vacuum in the second end port.

If the source vacuum is at this time still above the shift point value, the vacuum passed to the operated device through the sustaining valve will increase until it again becomes sufficient at the control port to switch the position of the valve over again.

However, if the source vacuum is below the predetermined value, the vacuum fed to the device will decay to the value of the source vacuum and will remain at the level of the source vacuum until it rises again above the value needed to shift the control valve.

The invention will now be further described, by way of example, with reference to the accompanying drawings, in which.

Figure 1:
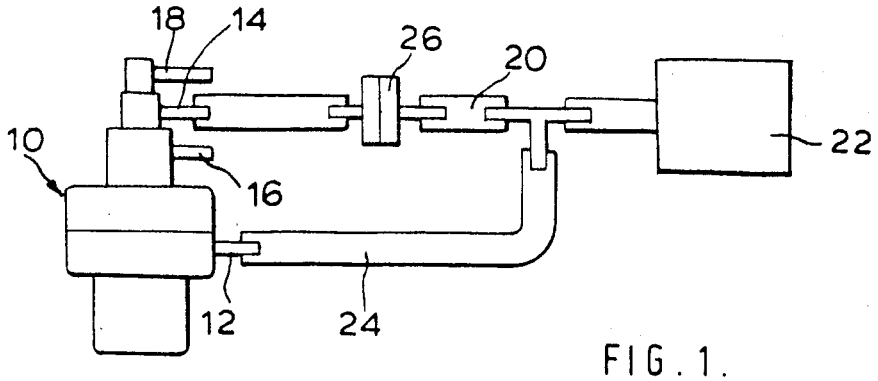
FIG. 1 is a schematic drawing of an arrangement in accordance with the invention.

A control valve indicated in general at 10 is shown in FIG. 1. This valve is described completely in U.S. Ser. No. 805,493, previously referred to. As described therein, it is a two position, three-port reciprocating control valve movable by a spring connected to a diaphragm. The diaphragm is movable in one direction by a vacuum in a control port, and is biased in the opposite direction by a compression spring. The valve controls flow between three operating ports 14, 16, 18 in the housing, a central port 14, and opposite end ports 16, 18.

The control valve member has an up position and a down position. In the up position, the valve allows communication between the first or central port 14 and the second or end port, and shuts off the third or opposite end port 18. In its alternate or other position, the control valve allows communication between the first and third ports 14 and 18 and shuts off the second port 16.

Movement of the control valve member is accomplished by vacuum applied to the control port 12, which is located below the operating diaphragm, not shown. At a predetermined level of vacuum, the control valve member will switch over from one position to the other.

The first or central port 14 is shown connected by a pipe 20 to a vacuum-driven or operated device 22. The second port 16 in this case is adapted to be connected to a source of vacuum, e.g., to an engine intake manifold. The third port 18 in this case is vented to the atmosphere. The control port 12 is connected by a pipe 24 and the T-type connector shown to the pipe 20 so as to be connected both to the first port 14 and the device 22.

Figure 4:
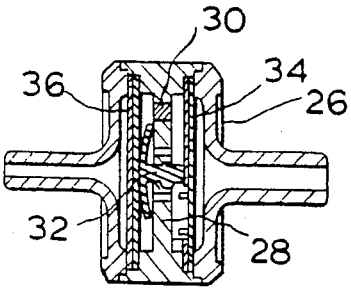
FIG. 4 is a cross-sectional view taken on a plane indicated by and viewed in the direction of the arrows IV—IV of FIG. 3.
Figure 3:
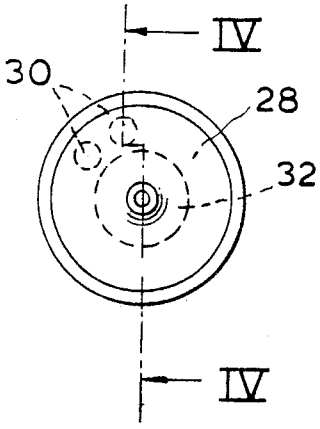
FIG. 3 is an enlarged end view of a detail of FIG. 1.

A vacuum control or sustaining valve 26 is connected in the pipe 20, between the first port 14 and the T-connection to the pipe 24. This latter valve, which is shown in more detail in FIGS. 3 and 4, consists of a central plate or partition 28 containing two sintered discs 30 mounted in holes in the plate, and a one-way valve 32 covering other holes in it. The sintered metal discs restrict or delay the flow between opposite sides of the partition. Filter discs 34 and 36 are fitted on either side of the plate 28. The valve 32 is of the flexible umbrella type, opening in response to a pressure differential in one direction, i.e., an increase in vacuum in device 22 relative to the pressure level in port 14, to allow air to pass through other holes shown in plate 28 towards the first port but closing to prevent free passage of air in the opposite direction when the pressure differential changes. Air can pass in this opposite direction, but only with a delayed action by bleeding through the sintered discs, which can only take place slowly.

Figure 2:
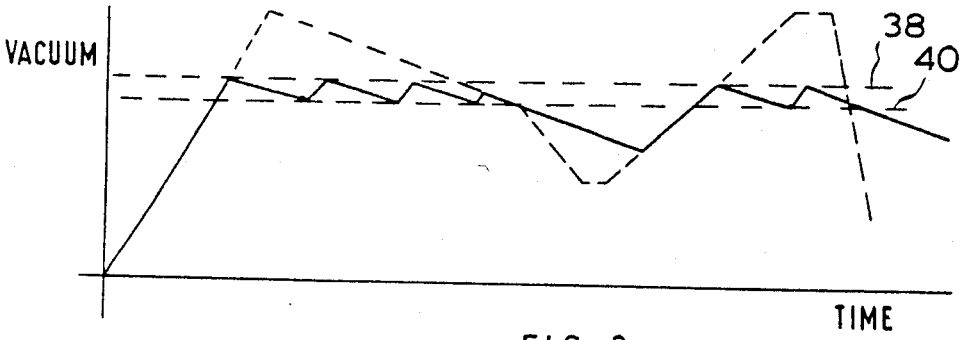
FIG. 2 is a graph illustrating the operation of the arrangement.

The operation of the arrangement now will be described following the graph of FIG. 2 in which the solid lines denote output vacuum supplied to the device 22, and dotted lines denoting input vacuum at the port 16.

Starting from an initial zero vacuum level, both input and output vacuums will rise together. At this stage, the first or central port 14 and the second or vacuum supply port 16 are in communication. The vacuum at this stage, however, is too low to operate the reciprocable control valve 10.

The pressure in device 22 initially will be atmospheric. Therefore, vacuum in line 20 will open the umbrella valve 32 and permit fast communication of vacuum to device 22 and control port 12. Upon receiving a preset predetermined or limiting value 38 of the vacuum level, the control valve 10 will switch to connect ports 14 and 18. Source vacuum in port 16 now is no longer fed to the device 22, although source vacuum may still be rising. Port 14 now will be connected to atmospheric pressure through vent line 18, so that the umbrella valve 32 will now be closed due to vacuum being in device 22. The vacuum in device 22, therefore, now only slowly decays by bleeding through the sintered discs 30 in the vacuum sustaining valve 26. Upon the vacuum reaching a second, lower vacuum value 40 in the device and at the control port 12, the control valve 10 then will switch back again to reconnect ports 14 and 16 and once again admit source vacuum to the device 22. This automatic switching of the control valve between the values 38 and 40 in FIG. 2 continues periodically so long as the source vacuum remains above the limiting value 38. When the source vacuum drops below the value 38, the control valve 10 will not necessarily switch over immediately, but will only do so once the vacuum trapped in device 22 and control port 12 has decayed to the lower limiting value 40. However, even When the source vacuum has dropped below the value 40, and the pressure has risen above the level in device 22, the output vacuum in device 22 and control port 12 will continue to decay slowly because it has to bleed through the sustaining valve discs 30. There will come a point where the input and output vacuums equalize, and thereafter the output vacuum will rise at the same rate as the input vacuum, but again will drop more slowly.

The difference between the values 38 and 40 will set the hysteresis of the system.

While the invention has been shown and described in its preferred embodiment, it will be clear to those skilled in the arts to which it pertains that many changes and modifications may be made thereto without departing from the scope of the invention.

I claim:

1. A vacuum limiting arrangement for use with a vacuum operated three-port, two position control valve having a control port, and a vacuum driven device, comprising, fluid flow-line means connecting a first port of the valve and the control port to the device, the control valve being shiftable by vacuum in the control port above and below respectively a predetermined level to alternate positions to connect the first port to a second vacuum supply port or alternately to a third atmospheric vent port, and a vacuum flow sustaining valve in the line means between the first port and the control valve arranged to allow unrestricted flow through the line toward the device but to restrict vacuum flow in the opposite direction to automatically control the shifting movement of the control valve as a function of vacuum level in the line means.

2. An arrangement as claimed in claim 1, wherein the control port is connected into the line means between the first port and the device at a location between the vacuum sustaining valve and the device.

3. An arrangement as in claim 1, wherein the sustaining valve contains a one-way check valve and flow restricting valves, a lower pressure at the device than at the first port effecting an unseating of the check valve and fast communication of the lower pressure level to the device and control port to quickly shift the control valve, the attaining of a higher pressure at the first port than at the device seating the check valve and permitting only a slow decay of the lower pressure at the control port and device through the flow restricting valves to delay the shifting of the control valve to its return position.

* * * * *